United States Patent [19]

Bailleul

[11] Patent Number: 4,689,443

[45] Date of Patent: Aug. 25, 1987

[54] ARMORED CABLE HAVING MINERAL INSULATION

[75] Inventor: Gilles Bailleul, Montesson, France

[73] Assignee: U.S. Philips Corporation, New York, N.Y.

[21] Appl. No.: 810,444

[22] Filed: Dec. 17, 1985

[30] Foreign Application Priority Data

Dec. 21, 1984 [FR] France ..... 8419658

[51] Int. Cl.[4] ..... H01B 7/16

[52] U.S. Cl. ..... 174/102 P; 29/614; 174/118; 338/238

[58] Field of Search ..... 174/102 P, 118; 29/614, 29/615, 616, 617; 338/238, 239, 240, 241, 242

[56] References Cited

U.S. PATENT DOCUMENTS

| | | | |
|---|---|---|---|
| 222,943 | 5/1843 | Lepetit | 174/102 P |
| 1,127,281 | 2/1915 | Read | 174/102 P |
| 2,351,056 | 6/1944 | Lepetit | 174/102 P |
| 2,669,636 | 2/1954 | Rawles | 338/238 X |
| 3,297,818 | 1/1967 | McCleery | 174/118 |
| 4,087,777 | 5/1978 | Clasen et al. | 174/102 P |

FOREIGN PATENT DOCUMENTS 84171 7/1983 European Pat. Off. .

*Primary Examiner*—Morris H. Nimmo
*Attorney, Agent, or Firm*—Norman N. Spain

[57] ABSTRACT

An armored cable having mineral insulation, comprising a metal central conductor and a cylindrical hollow metal sheath between which a powdered refractory insulating material is interposed, characterized in that the mineral insulating material is a mixture of 10 to 30% by weight of magnesium oxide (MgO) and 70 and 90% by weight of silicon oxide ($SiO_2$).

3 Claims, 3 Drawing Figures

ARMORED CABLE HAVING MINERAL INSULATION

BACKGROUND OF THE INVENTION

The invention relates to an armoured cable having mineral insulation, comprising a metal conductor and a hollow metal cylindrical sheath surrounding the conductor and between which a powdered refractory insulating material is interposed.

The invention is employed in electronic measuring and recording systems for transmitting electric signals supplied by sensing means for physical quantities.

Such a cable is known from, for example, European Patent Application No. 0,084,171 AL. This application describes an electric cable comprising a central titanium conductor and a hollow metal sheath also of titanium, the central conductor being insulated from the sheath by a mineral refractory insulating material, such as magnesium oxide or aluminum oxide.

Although this European Patent application notes the manufacturing problems which are attributable to the metal used for the conductor and the sheath, it does not solve the problems which would arise if an insulating material other than magnesium oxide or aluminum oxide were used.

Consequently, one of the essential conditions for the cables to perform well is that these cables, which may be very long (>20 m), are homogeneous over their entire length. This condition is fulfilled only if the mineral insulation, which is introduced in powder form between the central conductor and the sheath during the production process, flows well and spreads evenly over the entire length of the cable, and if the grains of the powder are homogeneous. This is the reason why so far only magnesium oxide or aluminum oxide has been used as an insulating material.

In order to adapt these cables to two types of devices to which they are connected, that is to say, on the one hand to sensing means and on the other to measuring and recording systems, the materials forming the cable must meet certain requirements.

Firstly, they must be resistant to high temperatures. In the prior art this problem is solved by using a metal conductor and a metal sheath and by employing a refractory insulating material such as magnesium oxide or aluminum oxide.

Moreover, they should have characteristic impedances of a predetermined value, for example, 30, 50 or 75Ω.

It is very difficult to manufacture cables having characteristic impedances which are so high, when use is made of the refractory insulating material described in this Patent Application. As a matter of fact, the characteristic impedance of a cable is an inverse function of the square root of the dielectric constant of the insulation as well as of the diameter of the central conductor. If refractory insulating materials having a high dielectric constant are used, such as magnesium oxide or aluminum oxide, it is necessary, in order to obtain the characteristic impendance within a predetermined range, to use a central conductor of a very small diameter, thus rendering the manufacture difficult and costly.

It has also been proposed to use very pure $SiO_2$ powder comprising at least 98% by weight of $SiO_2$ as a mineral insulating material. Cables having such an insulation are used at hyperfrequencies instead of at the usual high frequencies. However, cables having an $SiO_2$ insulation are difficult to manufacture. An extrusion process is used for their manufacture, in which a central wire which is coated with a layer of molten $SiO_2$ is elongated until the desired diameter of the wire and the coating is obtained. The $SiO_2$-coated central conductor is led into a hollow tube which is also subjected to a drawing process until the desired diameter is obtained. These process steps are very laborious. The resultant cable has a high porosity of approximately 60% (percentage of air within the outer conductor). Consequently, the central conductor is poorly positioned and may break easily.

SUMMARY OF THE INVENTION

For this reason, the object of the present invention is to supply an armoured cable having mineral insulation, the insulation being such that the desired characteristic impedance is obtained and that the cable is easy to manufacture, of a high quality and homogeneous.

In accordance with the present invention, this object is achieved by a cable as defined in the opening paragraph, characterized in that the mineral insulation is a mixture of 10 to 30% by weight of magnesium oxide (MgO) and 70 to 90% by weight of silicon oxide ($SiO_2$).

In accordance with a preferred embodiment, the said cable is characterized in that the central conductor is of copper, the metal sheath is of a material formed from a succession of iron, copper and stainless steel layers, and the mineral insulation is formed from 20% by weight of magnesium oxide (MgO) and 80% by weight of silicon oxide ($SiO_2$).

In this case, the characteristic impedances of the present adaptations are obtained by means of diameters of the central conductor which facilitate an easy manufacture and by means of an insulating material whose performance is comparable with that of high-purity insulating materials.

The cable in accordance with the invention can be produced in a simple way in a drawing process. In this process a hollow metal outer conductor having a large diameter is used, which already comprises the central inner conductor and the powdered insulating material. Next, the assembly is drawn (elongated) until the required diametrical dimensions are obtained. The porosity is less than 30 to 35%, customarily it is about 20%. The central conductor is properly fixed.

DETAILED DESCRIPTION OF THE INVENTION

Figure 1:
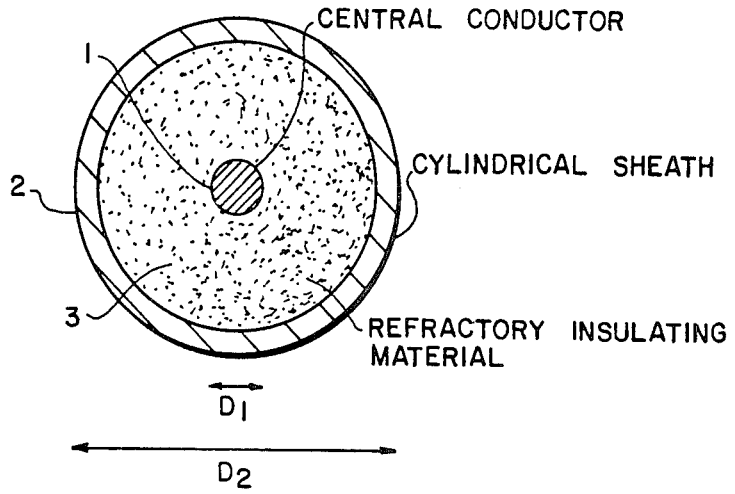
FIG. 1 is a cross-sectional view of an armoured cable having mineral insulation in accordance with the invention.
Figure 2:
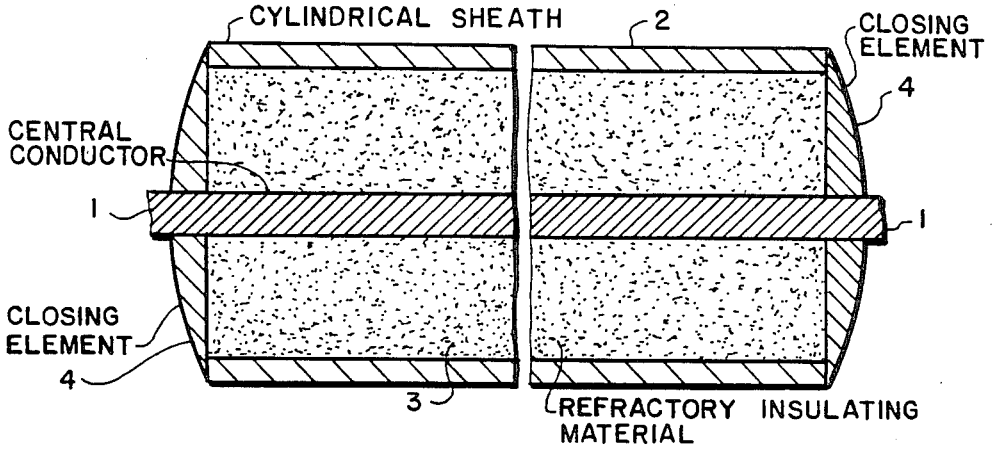
FIG. 2 is a longitudinal sectional view of an armoured cable having mineral insulation in accordance with the invention.
Figure 4:
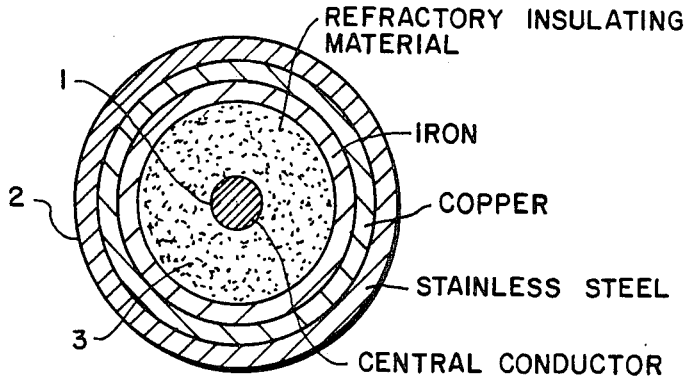
FIG. 4 is a cross-sectional view of an armoured cable, similar to that in FIG. 1, but showing the structure of the sheath.

As shown in FIGS. 2 and 4, the cable in accordance with the invention is formed from a metal central conductor 1 having a diameter $D_1$, from a cylindrical sheath 2 having an internal diameter $D_2$ and from a refractory insulating material 3 which is interposed between the central conductor and the sheath. The sheath may be closed at each end, for example, using closing elements 4.

The characteristic impedance $Z_C$ of the cable is shown in the equation:

$$Z_C(in\ \Omega) = \frac{60}{\gamma\epsilon} \Big|_n \frac{D_2}{D_1} \quad (1)$$

where $\epsilon$ is the dielectric constant of the insulating material.

The value of the capacity of the cable is indicated by the equation:

$$C = \frac{\epsilon}{18 \Big|_n \frac{D_2}{D_1}}$$

These equations clearly show that for a given characteristic impedance of, for example, 50 Ohms the diameter of the central conductor must be smaller according as the dielectric constant is higher.

However, the diameter of the central conductor cannot be reduced beyond certain limits during the fabrication process without risking breakage of the conductor.

Consequently, the dielectric constant of the insulation must be varied. But in that case a technological problem will present itself. In the first place, the insulating material selected must be refractory. This rules out the possibility of using organic insulating materials which, although they have a low dielectric constant in the order of 1, are not resistant to high temperatures.

On the other hand, the insulating material must be capable of forming a powder of regularly shaped grains enabling a uniform and homogeneous distribution between the conductor and the sheath, and forming a dense and still homogeneous mass during the wire drawing process and the thermal treatment which form part of the manufacturing process of the cable.

So far, the only constituents which meet these requirements are magnesium oxide or aluminium oxide. However, these constituents have high dielectric constants as shown in table I.

TABLE I

| Insulation material | $\epsilon$ | Density |
|---|---|---|
| MgO | 8,2 | 3,58 |
| $Al_2O_3$ | 9,4 | 3,95 |
| $SiO_2$ | 3,6 | 2,32 |

On the other hand, as is also shown in table I, silicon oxide has a low dielectric constant.

Nevertheless, so far it has not been possible to use silicon oxide as an insulating material because the quality of the cables thus obtained are unsatisfactory as the distribution of the insulating material between the conductor and the sheath is not homogeneous and the cable is poorly resistant to high temperatures.

In accordance with the present invention, a high-performance cable whose performance is comparable with that obtained using only magnesium oxide as an insulating material, may be obtained using a mixture of magnesium oxide and silicon oxide as an insulating material.

There is a rule regarding the composition of dielectric constants of mixtures, which is expressed by the equation:

$$1\ g\epsilon = \Sigma Ci.1\ g\epsilon_i \quad (3)$$

where Ci is the volumetric concentration.

If, for example, in a cable which is insulated using silicon dioxide $SiO_2$, the porosity is in the order of 30% (which is a common value), the dielectric constant will be expressed by: 1 g $\epsilon$=0.7 log 3.6 consequently, $\epsilon$=2.45

If the cable is fabricated using a powdered mixture, the dielectric constant will be $$lg\epsilon = 0.7 \frac{\Sigma \frac{Ci}{di}\ lg\epsilon i}{\Sigma \frac{Ci}{di}}$$

Figure 3:
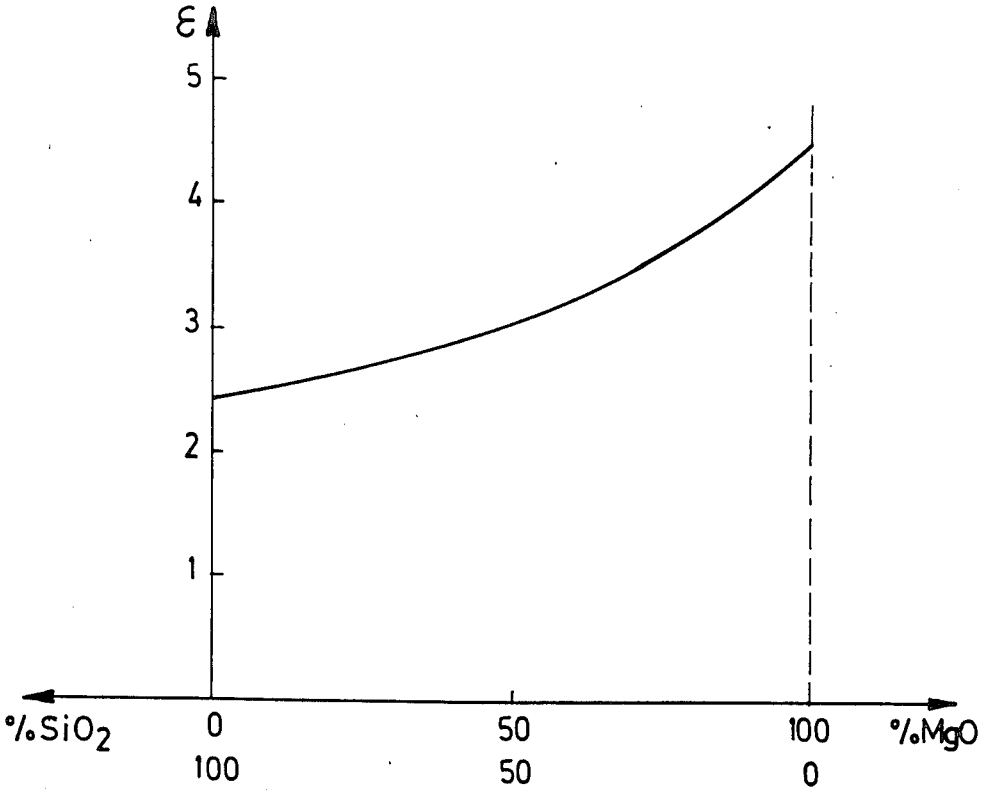
FIG. 3 shows the curve of the dielectric constant of the mineral insulation as a function of the composition of the MgO-$SiO_2$-mixture, in the case where the mixture includes 30% of air.

With regard to the powdered mixture of magnesium oxide (MgO) and silicon oxide ($SiO_2$), including 30% of air, the curve of FIG. 3 shows the dielectric constant as a function of the content of the mixture, the compositions being expressed in weight.

This curve shows that the dielectric constant of the mixture increases only slightly as long as the percentage of magnesium oxide does not surpass 30% by weight.

Consequently, it is interesting to use a magnesium oxide (MgO)-silicon oxide ($SiO_2$) mixture which comprises between 10 and 30% by weight of magnesium oxide. In that case, the dielectric constant being low, the diameter of the central conductor will be of suitable size and the desired characteristic impedance will be obtained.

EXAMPLE OF AN EMBODIMENT

In this embodiment of the cable in accordance with the invention:

- the central conductor is made of copper;
- the metal sheath is formed from a succession of iron, copper and stainless steel layers;
- the mineral insulation contains: 20% by weight of magnesium oxide and 80% by weight of silicon oxide;
- the dielectric constant of the insulator is: 2,67
  - and for a sheath having an internal diameter $D_2$=4.6 mm
  - the central conductor has a diameter $D_1$=0.6 mm and the characteristic impedance of the cable is 75Ω.

What is claimed is:

1. An armoured cable having mineral insulation, comprising a metal central conductor and a cylindrical hollow metal sheath between which a powdered refractory insulating material is interposed, characterized in that the mineral insulating material is a mixture of 10 to 30% by weight of magnesium oxide (MgO) and of 70 to 90% by weight of silicon oxide ($SiO_2$).

2. An armored cable comprising a metal central conductor, a cylindrical hollow metal sheath and a powdered refractory insulating material consisting essentially of a mixture of 10 to 30% by weight of magnesium oxide (MgO) and 70 to 90% by weight of silicon oxide ($SiO_2$) interposed between said cylindrical hollow metal sheath, said sheath consisting of a layer of iron facing said metal insulating material, an intermediate layer of copper and an outer layer of stainless steel.

3. An armored cable comprising a central conductor made of copper, a cylindrical hollow metal sheath of an inner layer of iron, an intermediate layer of copper and an outer layer of stainless steel and a powdered refractory insulating material interposed between said central conductor and said cylindrical hollow metal sheath and consisting essentially of 20% by weight of magnesium oxide (MgO) and 80% by weight of silicon oxide ($SiO_2$).

* * * * *

UNITED STATES PATENT AND TRADEMARK OFFICE

CERTIFICATE OF CORRECTION

PATENT NO. : 4,689,443

DATED : August 25, 1987

INVENTOR(S) : Gilles Bailleul

It is certified that error appears in the above-identified patent and that said Letters Patent is hereby corrected as shown below:

| | | |
|---|---|---|
| Claim 2, | line 7 | after "sheath," (first occurrence) insert --and said metal central conductor,-- |
| | line 8 | delete "metal" |

Signed and Sealed this

Fourteenth Day of February, 1989

*Attest:*

DONALD J. QUIGG

*Attesting Officer*

*Commissioner of Patents and Trademarks*